US006174270B1

(12) United States Patent
Dagenais

(10) Patent No.: US 6,174,270 B1
(45) Date of Patent: Jan. 16, 2001

(54) TRAINING AND EXERCISE APPARATUS FOR GOLF

(76) Inventor: Michael M. Dagenais, 76 Vanier, Aylmer, Quebec (CA), J9H 1X3

( * ) Notice: Under 35 U.S.C. 154(b), the term of this patent shall be extended for 0 days.

(21) Appl. No.: 09/296,461

(22) Filed: Apr. 22, 1999

Related U.S. Application Data

(63) Continuation-in-part of application No. 08/783,942, filed on Jan. 21, 1997, now abandoned.

(51) Int. Cl.[7] ..... A63B 22/14; A63B 69/36

(52) U.S. Cl. ..... 482/148; 482/93; 473/276; 434/252

(58) Field of Search ..... 473/276, 266; 434/252; 482/148, 51, 91, 92, 139, 107, 10, 142, 100, 101, 136, 908

(56) References Cited

U.S. PATENT DOCUMENTS

| | | | | |
|---|---|---|---|---|
| 4,757,992 | * | 7/1988 | Heitsch et al. | 482/136 |
| 4,758,000 | * | 7/1988 | Cox | 273/190 |
| 5,039,105 | * | 8/1991 | Ro | 473/276 |
| 5,050,885 | * | 9/1991 | Ballard et al. | 434/252 |
| 5,156,402 | * | 10/1992 | Hart | 273/191 |
| 5,242,344 | * | 9/1993 | Hundley | 482/93 |
| 5,586,761 | * | 12/1996 | Brock et al. | 473/276 |

* cited by examiner

*Primary Examiner*—Stephen R. Crow
(74) *Attorney, Agent, or Firm*—McFadden, Fincham

(57) ABSTRACT

The present invention discloses a golf training and exercise device capable of restricting a player's body position and movement to follow a rotation plane variably adjustable in three axes while exerting a lateral force against a player's upper body. The present invention comprises an exercise device for guiding pivotal and lateral movement of a player's upper body including a support standard, a positioning arm including means for variable height adjustment mounted to project from the standard, a rotational axle on the positioning arm defining a primary axis of rotation having adjustment means for positioning the axle relative to two additional axes, a yoke for receiving a player's shoulders rotatively secured by the axle to the positioning arm, and a pair of depending arms spaced apart on said yoke for confining a player against the yoke and for exerting a lateral force against a player's shoulders during rotation. Advantageously, the present invention provides a repeatable movement, so that the student or professional can return to the same specific motion from one session to the next. The device can also be used to measure and extend movement flexibility. These exercise movements can also be beneficial to other athletic activity.

33 Claims, 6 Drawing Sheets

TRAINING AND EXERCISE APPARATUS FOR GOLF

This application is a continuation in part of Ser. No. 08/783,942, filed Jan. 21, 1997, Abn.

FIELD OF THE INVENTION

The present invention relates to a golf training and exercise apparatus which reinforces correct stance and swing movement. In particular the present invention provides a golf training and exercise device capable of restricting a players body position and movement to follow a rotation plane variably adjustable in three axes, while exerting a lateral force against a player's upper body.

BACKGROUND OF THE INVENTION

Numerous devices have been proposed to teach or correct the golf swing. Many are directed toward guiding the path of the club without controlling the movement of the player. Prior art devices which do try to control body movement are generally overly restrictive, complicated and inaccurate in the movement defined.

U.S. Pat. No. 5,156,402 issued to Hart discloses a stand which holds a handle for any athletic swinging movement with a linkage mechanism which controls movement of the handle. The machine provides resistance in order to assist as a strengthening exercise. The swing is not specifically for golf and the device does not control the position or movement of the player.

U.S. Pat. No. 4,318,546 to Chen discloses a device designed to restrict the movement of the player employing an arrangement of cross bars and straps rotationally mounted on a pivotal stand. The straps are provided to secure both the hips and shoulders of a player to the cross bars for rotation about a single axis defined by the pivotal stand. However, human mechanics do not permit the simple movement prescribed by this device. The spine does not rotate, but twists in a helix of many different axes. The hips cannot pivot about the same axis as the shoulders, and the attempt to do so would result in compensation to position and movement counter productive to the golf swing. Further, the axis for rotation of this device is not fixed, but is freely pivotal. This removes control of the motion, as the axis can change throughout the movement, and also makes it difficult for a player to use the device to return to a specific movement. Securing the player to the apparatus hinders development of the movement and supporting muscles which would occur if the player were self supported.

U.S. Pat. No. 4,758,000 issued to Cox discloses a mechanical device which provides more restriction to body movement. The player is effectively immobilized in a mechanical device which provides three pivotal linkages, to the head, the shoulders and the arms. However, the device is unsatisfactory because it is not possible to make the range of motion necessary for an effective swing. The players head is immobilized to rotation on a single axis, while the shoulders are allowed relatively free movement against a universal linkage without making any lateral movement. This produces a contorted position (seen in FIG. 4) with the head down to the side and the shoulders fully raised. The arm swing is linked by cables to the shoulder brace to force the body to twist, giving primary control to the minor muscle movement. This does not effectively guide the large body movement and requires the body to compensate for flaws caused by the swing. Again, the player is supported and moved by the apparatus, hindering development of the movement independently.

It is desired to place a players body in a correct posture for a correct swing, and to guide the body through a movement in position to make an effective swing, while preventing compensating leg movement or body tilt. It is also desired to provide a device which establishes a consistent movement to which a player may return, and against which a player may measure progress in flexibility and strength.

SUMMARY OF THE INVENTION

It is an object of the present invention to provide a device which can be used to control body movement specific for a golf swing, and which can be used as a training and an exercise device to extend that range of movement. The present invention confines a player to movement about a specific axis. The depending arms establish a compact position forcing the complete upper body to pivot and make a lateral shift, not accomplished in the prior art.

Accordingly the present invention provides an exercise device for guiding pivotal and lateral movement of a player's upper body comprising:

- a yoke for receiving a player's shoulders having at least one depending arm at least partially surrounding a player's body for contacting a player's shoulders to exert a lateral force against the player's shoulders; a yoke head mounted to the yoke; means associated with the head for rotation of the yoke about a primary axis; means for setting a variable angular orientation of said primary axis relative to a horizontal axis;
- a stand for supporting the yoke including means for adjustment to the height of said yoke; and
- a positioning arm joining the head to the stand and displacing the head forwardly of the stand.

In a preferred embodiment of the present invention the yoke rotates relative to the head, and may be supported by an axle journalled within the head for free rotation of the yoke about the head, including a pair of pivot pins for setting angular orientation of the primary axis relative to a horizontal and a vertical axis.

In a further preferred embodiment the present invention provides an exercise device for guiding pivotal and lateral movement of a player's upper body comprising:

- a support standard;
- a positioning arm including means for variable height adjustment mounted to project from the standard;
- a rotational axle on the positioning arm defining a primary axis of rotation having adjustment means for positioning the axle relative to two additional axes;
- a yoke for receiving a players shoulders rotatively secured by the axle to said positioning arm; and
- a pair of depending arms spaced apart on the yoke for confining a player against said yoke and for exerting a lateral force against a players shoulders during rotation.

In a still further preferred embodiment the present invention provides an exercise device for guiding pivotal and lateral movement of a player's upper body comprising:

- a yoke for receiving a player's shoulders having at least one arm for at least partially surrounding a player's body and contacting a player's shoulders, said yoke being mounted to a yoke head; a means associated with said head for rotation of said yoke relative to said head about a primary axis substantially parallel to at least a portion of a player's spine, and including means associated with said head for setting a variable angular orientation of said primary axis relative to a horizontal axis;

a stand for supporting said yoke including means for adjustment to the height of said yoke; and a positioning arm joining said head to said stand and displacing said head forwardly of said stand.

The yoke head preferably comprises first and second parts pivotally joined by a pivot pin. The axle which defines the first axis is journalled within the first part, and a further pivot mount joins the second part of the head to the positioning arm. The pivot mount defines the second axis of rotation. The pivot pin joining the first and second parts of the head defines a third axis. The three axes are substantially mutually perpendicular. A latch between the first and second parts of the head permits a selectively operable latch function to fix the third axis.

The motion created by the golf training and exercise device is compatible with the fill variety of teaching methods or schools. The apparatus is ambidextrous, being able to accommodate left or right swing players. Advantageously, the present invention provides a repeatable movement, so that the student or professional can return to the same specific motion from one session to the next. The device can also be used to measure and extend movement flexibility. These exercise movements can also be beneficial to other athletic activity.

BRIEF DESCRIPTION OF THE FIGURES

Features of the present invention will be more clearly understood through reference to the following drawings which illustrate the invention by example only. Like references are used throughout to identify like elements.

DETAILED DESCRIPTION OF THE PREFERRED EMBODIMENTS

Figure 1:
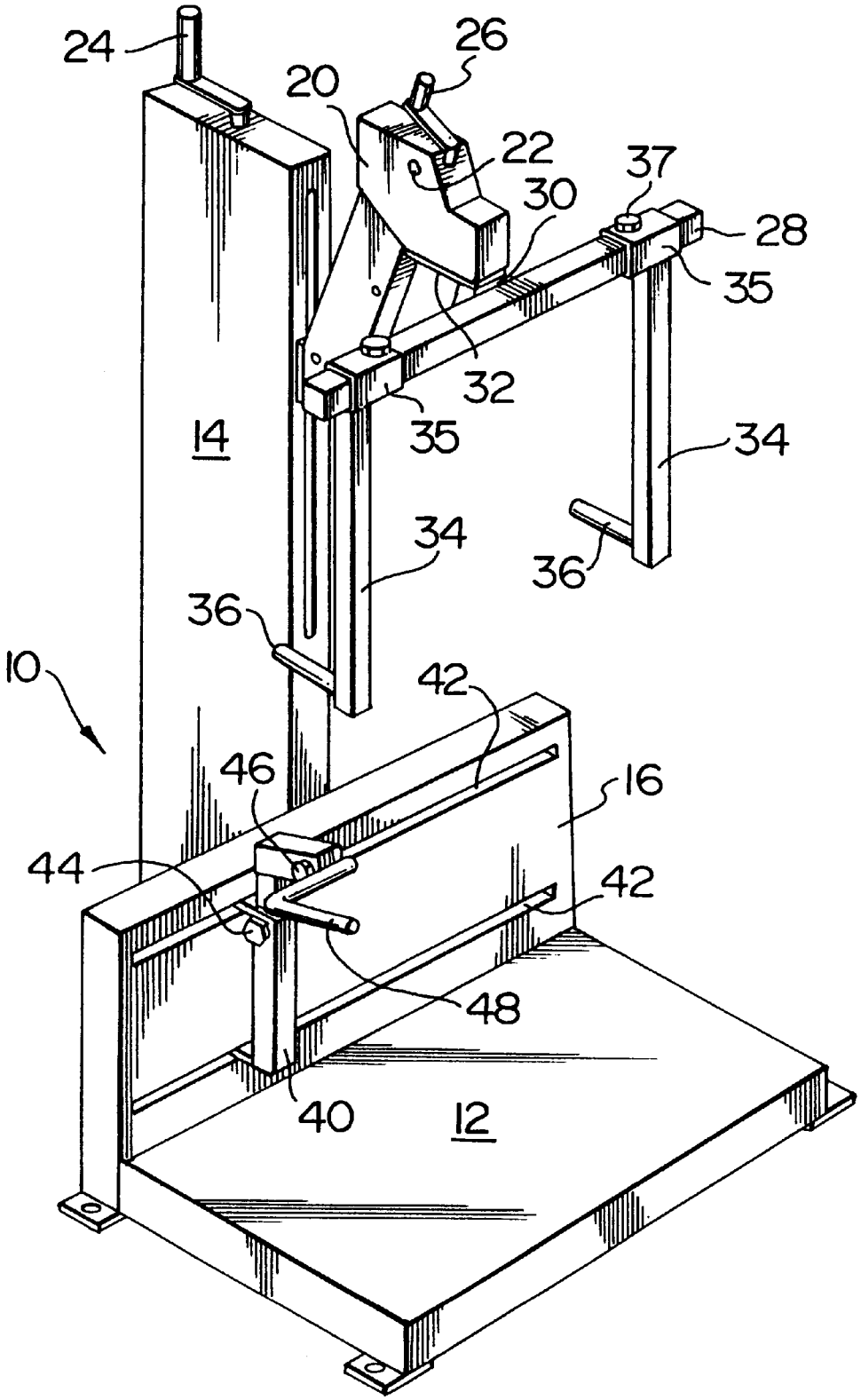
FIG. 1 is a perspective view of a preferred embodiment of the present invention, illustrating straight arms positioned in the lowest angle position.

A preferred embodiment of the present invention is shown generally at 10 in FIG. 1. A base 12 having a sufficient dimension to provide a standing platform for the player, supports a vertical standard 14 and a back plate 16. A yoke 28, which guides the movement of the player's body, is rotatively mounted via a yoke head 20 on a positioning arm 18 which extends from the standard. To develop a player's strength, it is important that the player moves freely within the machine, initiating all movement. Prior art designs support and move the player mechanically, inhibiting independent ability to recreate the motion.

Figure 7:
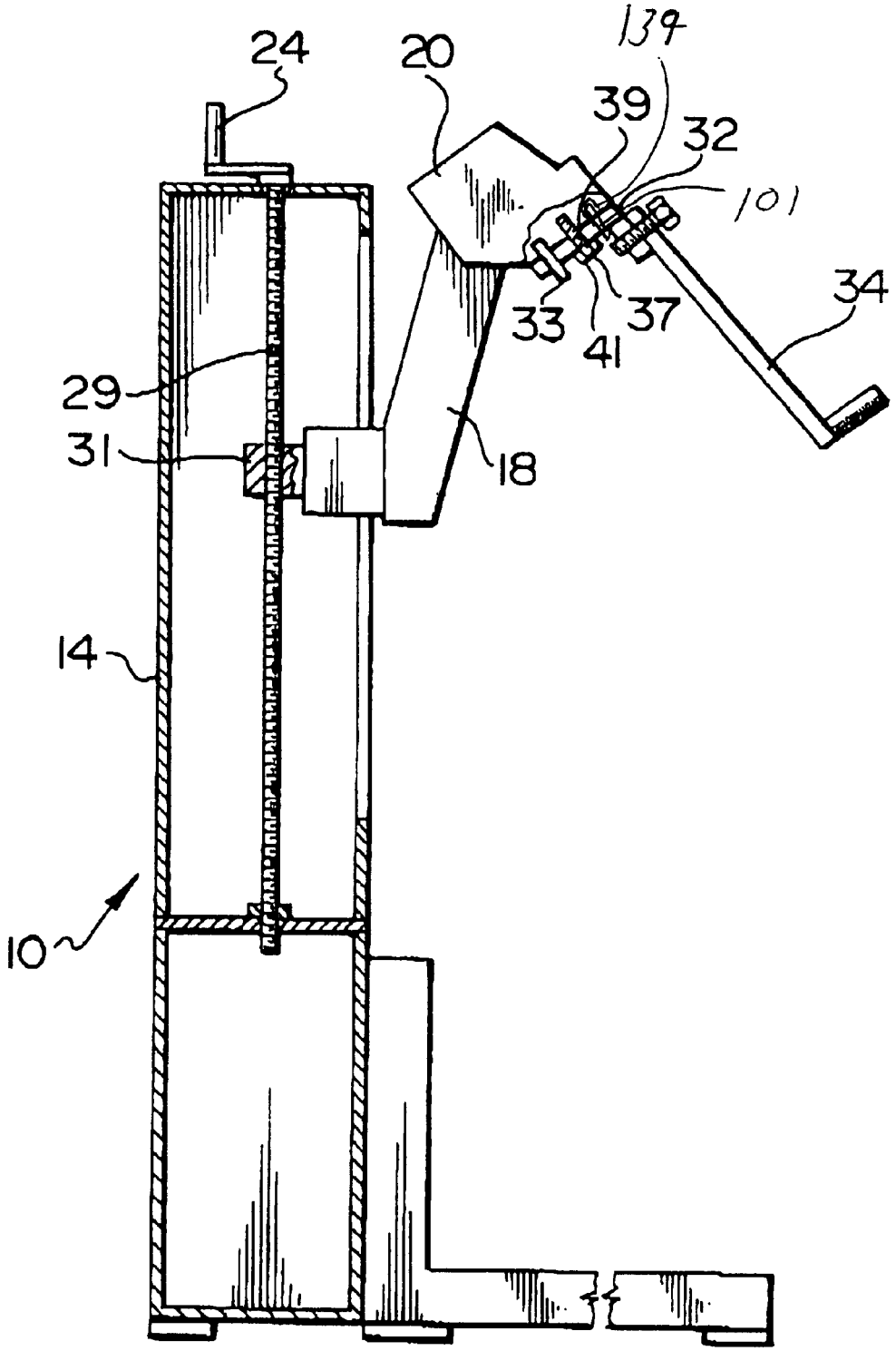
FIG. 7 is a sectional view along line 7—7 of FIG. 2.

The positioning arm 18 extends from the standard 14 secured by a vertical adjustment mechanism (seen in FIG. 7,) such as a rack and pinion, worm gear, gas cylinder, or any other suitable mechanism. The vertical adjustment mechanism provides height and adjustment means for the yoke to which the positioning arm is mounted. The adjustment means conveniently comprises a threaded warm gear within the vertical standard mating a pinion on the arm 18. Vertical adjustment of the positioning arm 18 using a worm gear is rotatively operated by a crank 24 to set the yoke 28 at an appropriate height. A calibrated guide is provided on the standard, so that a desired height may be easily reset.

Figure 2:
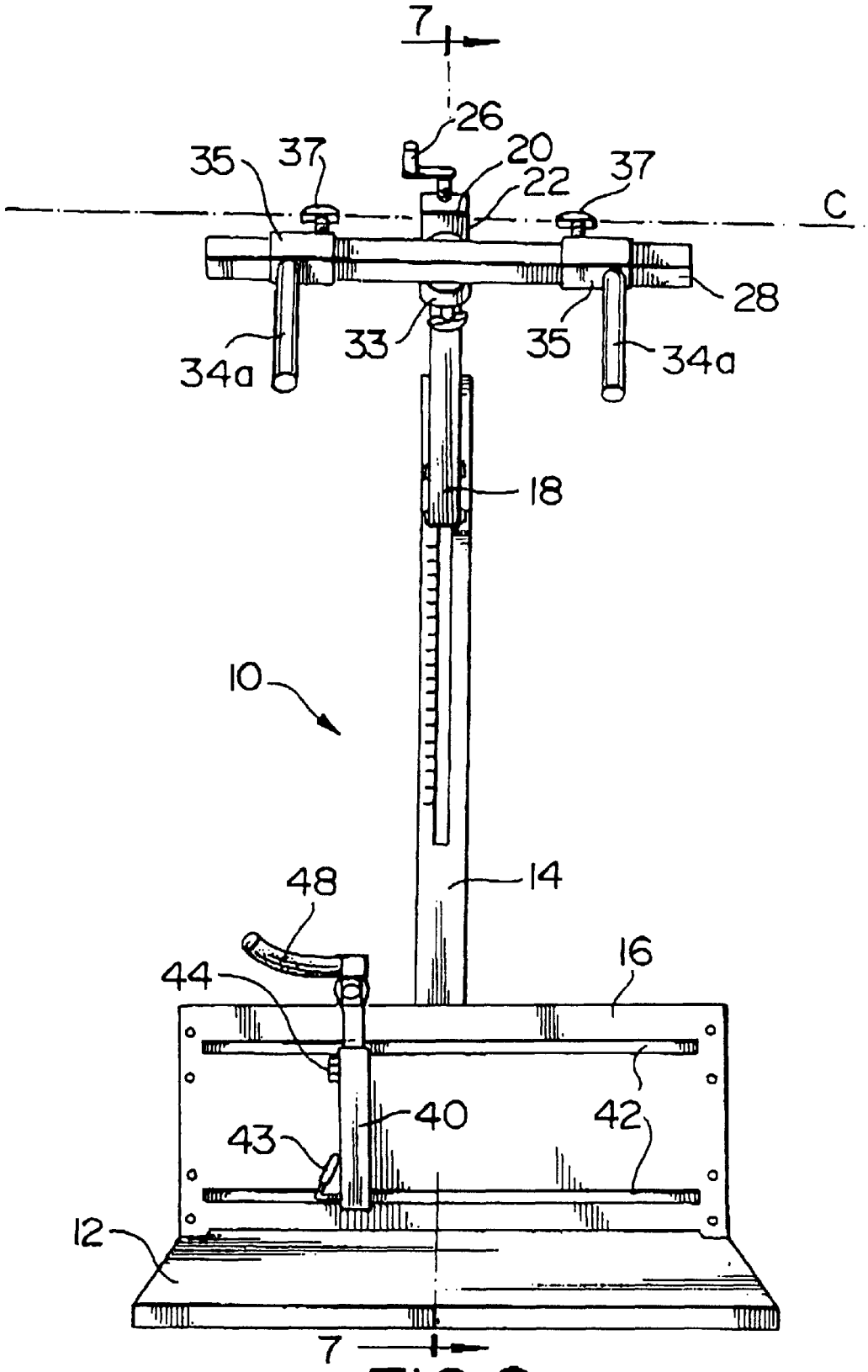
FIG. 2 is a front view of the embodiment of FIG. 1, illustrating short arms.
Figure 3:
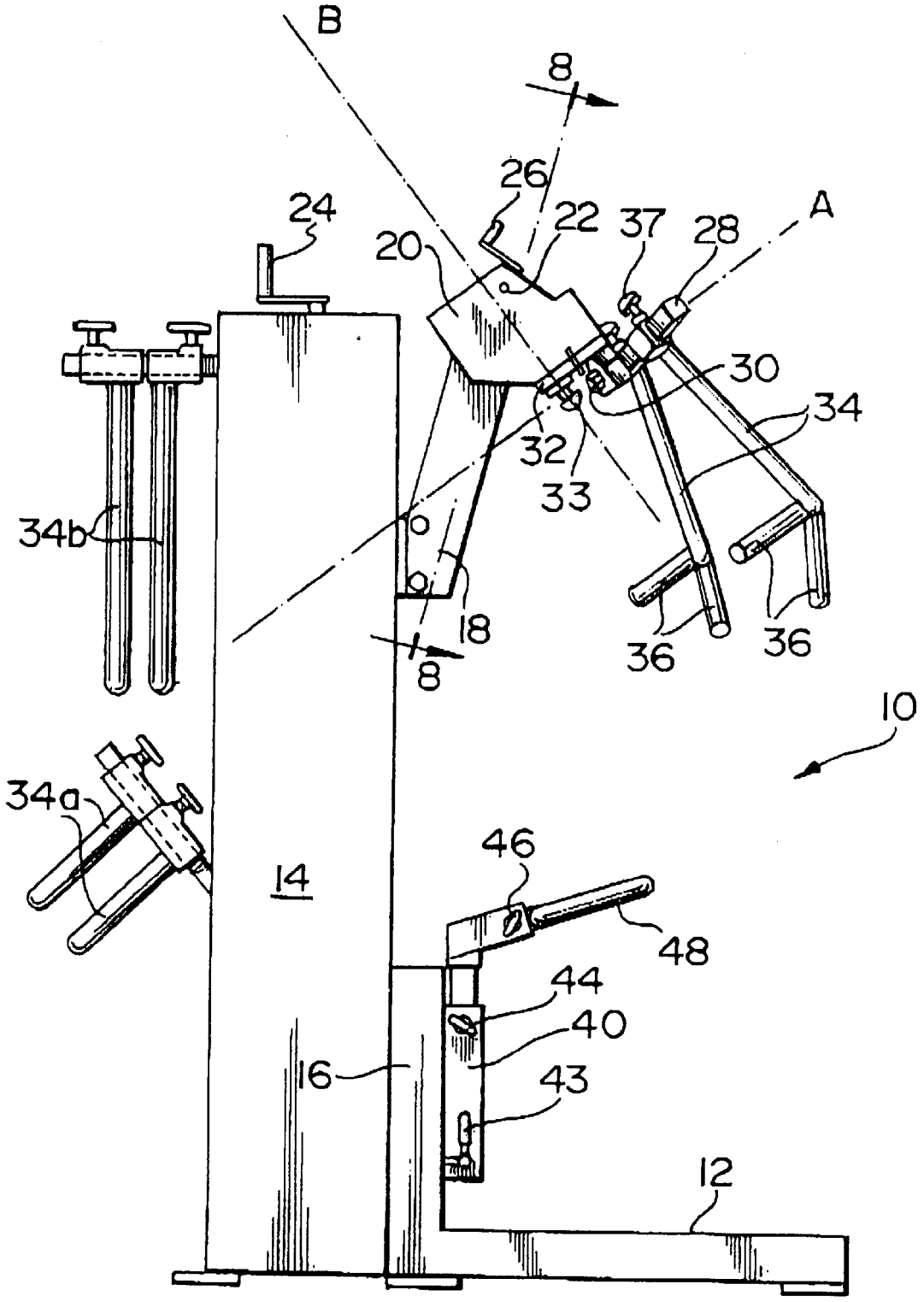
FIG. 3 is a side view of the embodiment of FIG. 1, illustrating angled arms positioned in a raised angle position.
Figure 8:
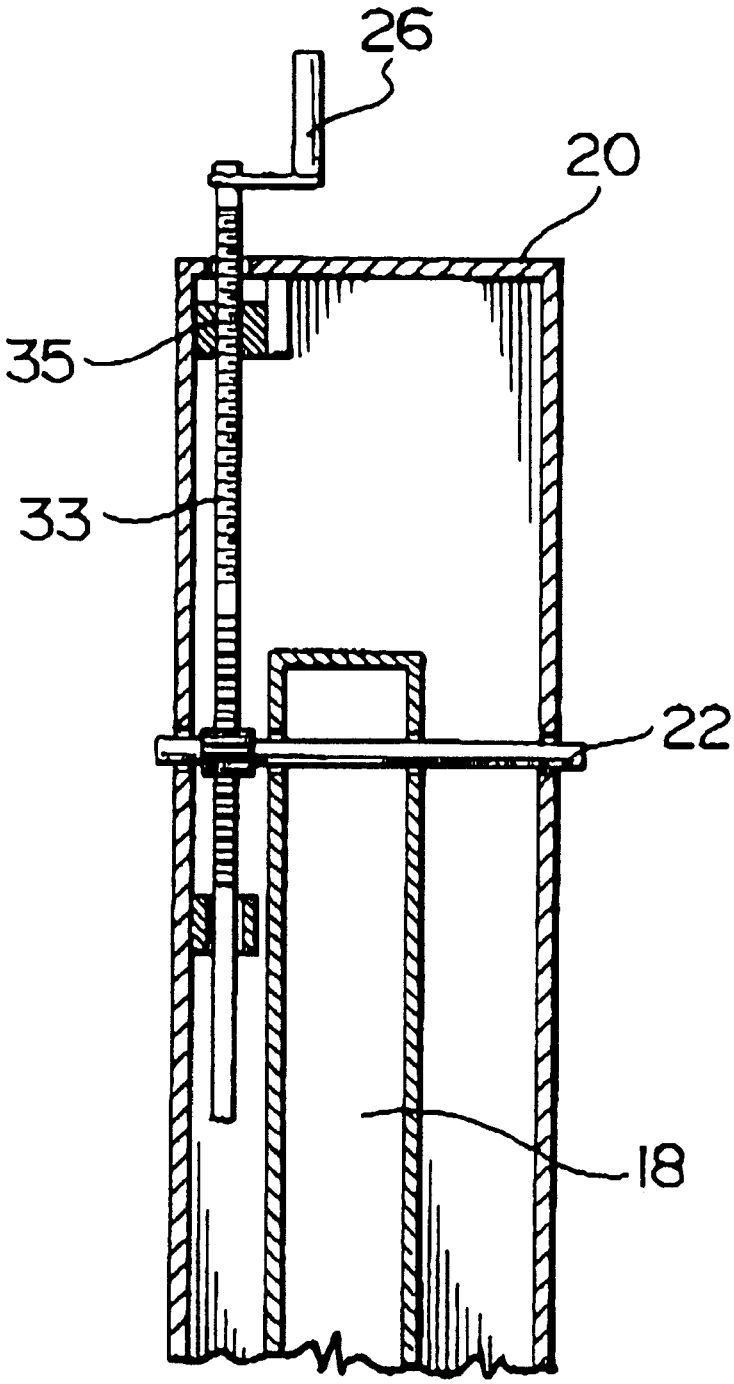
FIG. 8 is a sectional view along line 8—8 of FIG. 3.

An angled head 20, seen most clearly in FIG. 3, is mounted for pivotal movement at the distal end of the positioning arm 18 on pivot pin 22, which defines a substantially horizontal axis C (seen in FIG. 2). As seen in FIG. 8, an internal threaded rotatable shaft and threaded bushing operated by crank 26 rotates the head 20 on the pivot pin 22 cooperate with the yoke support head 20 to set the head in a fixed position at a desired angle. The head 20 supports the yoke 28 for freely rotative movement on an axle 30, which defines a primary axis A (seen in FIG. 3). The angle of the axle 30, and hence the primary axis A, and the plane of rotation of the yoke 28, is set by adjusting the angle of head 20. Adjustment to both the height and angle of inclination allow the apparatus 10 to accommodate differences in players' body builds. For different exercises the axle 30 may be positioned substantially horizontally through an angular range to substantially vertically. A preferred range is approximately 5° above horizontal to approximately 65° above horizontal.

Axle 30 is secured to the head 20 on a plate 32 pivotally mounted on a pivot pin 33 defining an axis B substantially perpendicular to ale 30, as seen in FIG. 3, providing three axes of rotation to the yoke 28. This axis B is subject to adjustment by the angular adjustment about pivot pin 22, but is referred to as a "vertical" axis, as it is when the axle 30 is in a horizontal position. The plate 32 includes a latch function which permits the plate to be rotated and latched in a set position for initial set of the apparatus. The latch function is provided by a latch pin 101, seen in FIG. 7, for variable adjustment of the angular position of the axle 30 via an array of latch pin holes 139. The latch may be released for free rotation. The angular adjustment thus provided is appropriate as a golfers shoulders are not generally in a square position holding a club. One hand is positioned above the other, and hence one shoulder is higher than the other. Once set, the plate 32 is latched against further rotation. Alternatively, for more complex movement the plate may be freely rotative on the pivot pin 33.

The yoke 28 comprises a substantially horizontal bar rotatively supported at its centre point on axle 30 within bearings for resistance-free rotation. Alternatively, resistance may be provided at this point for more strength oriented exercise. The yoke 28 has a pair of depending arms 34 spaced apart at either end of the yoke 28 which confine the shoulders and urge lateral movement in the players upper body during rotation. The spacing of the arms 34 is preferably adjustable, for instance employing sliding mounts 35 and thumb screws 37, to accommodate different sized players. Calibrations are provided on the yoke 28 so that a desired spacing may easily be reset. The sliding adjustment of the arms 34 also permits an initial set-up off centre, if desired for a particular teaching method or style. One of the arms 34 may be removed to focus attention on particular movement exercises. Handle grips 36 are provided at the ends of the depending arms 34 as a support to the player for balance. The handle grips 36 may be at different orientations to imitate hand positions during a swing.

The arms 34 are shaped to accentuate different body movements, and to stretch or strengthen different muscle groups. The straight arms 34, illustrated in FIG. 1, confine the player's body providing the most control over the player's movement. In particular, the straight arms 34 exert the most lateral force on the upper body. The lateral movement of the upper body orients the players body at an angle termed the V-angle considered necessary for proper address of the ball. This motion is extended and somewhat exaggerated in order to counter act a player's natural tendency to tilt toward the target.

Shorter arms 34*a,* as shown in FIG. 2, are provided to free the players arms in order to hold and swing an actual club, without being restrained, while still exerting a lateral force. Wide arms 34*b,* seen clearly in FIG. 5, open the player's body position increasing flexibility in specific muscle groups, and are suited for use as a stretching exercise. On the wide angled arms 34*b,* two pairs of handle grips 36 are provided at angles to imitate hand grip positions for right or left handed players.

On the back plate 16 a leg brace 40 is mounted for sliding adjustment in tracks 42 to set the horizontal position. Pedal 43 acts against the base 12 to prevent further lateral motion once in place. The leg brace 40 further includes telescopic adjustment using thumb screw 44 for height and a second thumb screw 46 for depth. A bracket 48 has a curved shape to impinge on a players leg to prevent bending to the side or moving back. The bracket 48 for engaging the player's leg can be removed and reversed for use on the inside or outside of either leg.

In use a player stands on the base 12. The positioning arm 18 is raised to place the yoke 28 at the appropriate height. A club, and hence stance is selected: upright for driving with a longer club, stooped to swing a short putter. As the player assumes a position, the angle of the spine changes. The angle of the head 20 is set using the crank 26 until the yoke 28 rests on the shoulders of the player. In this position the axle 30 is substantially parallel to the player's spine at the shoulder blades so that rotation of the yoke 28 closely matches the players range of pivotal movement.

In the apparatus 10 the player is forced to stand in a posture placing the shoulders ahead of the hips and feet desired for a correct swing. The handle grips 36 help the player to adjust to the sensation of imbalance. Throughout the swing a correct body posture is maintained. This posture is difficult to teach, and the source of common problems among golfers.

Figure 6:
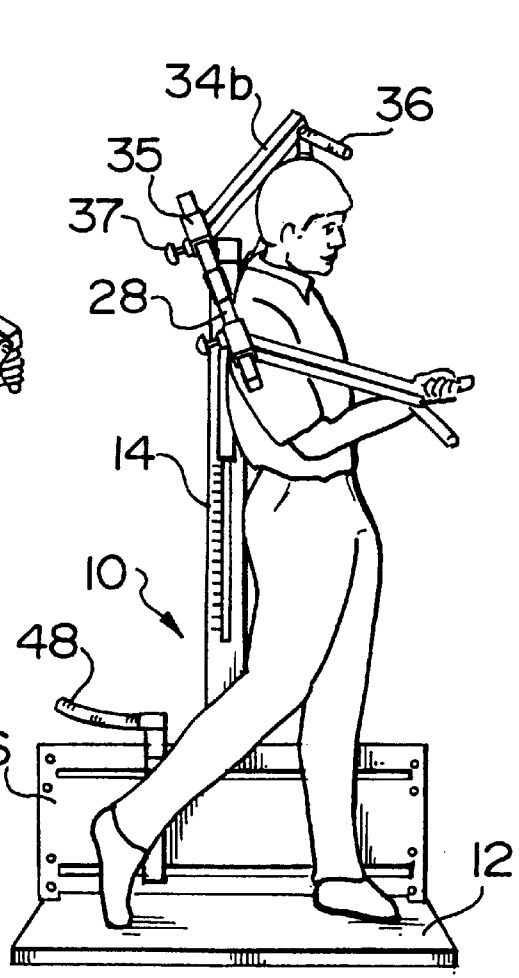
FIGS. 4–6 illustrate a sequence of a player using the apparatus of FIG. 1.
Figure 5:
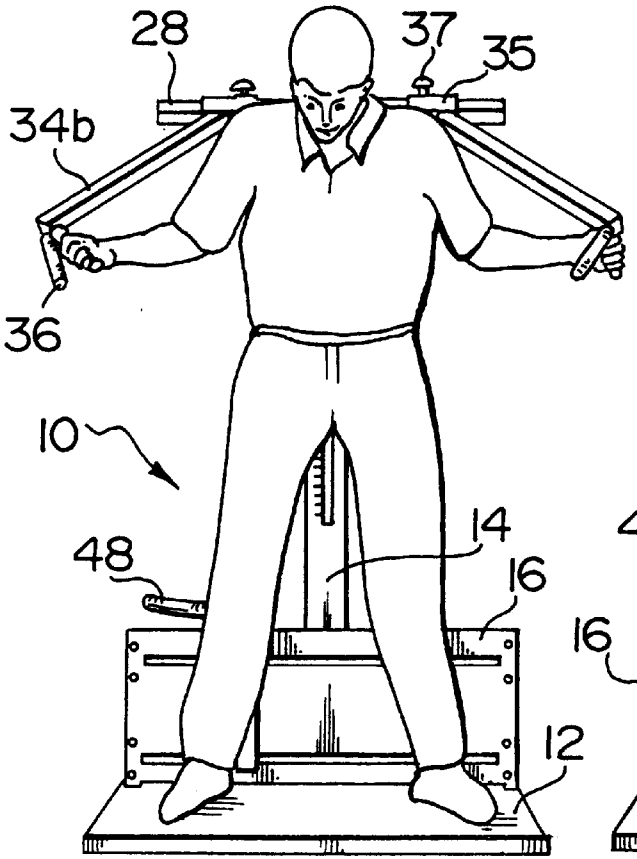
Figure 4:
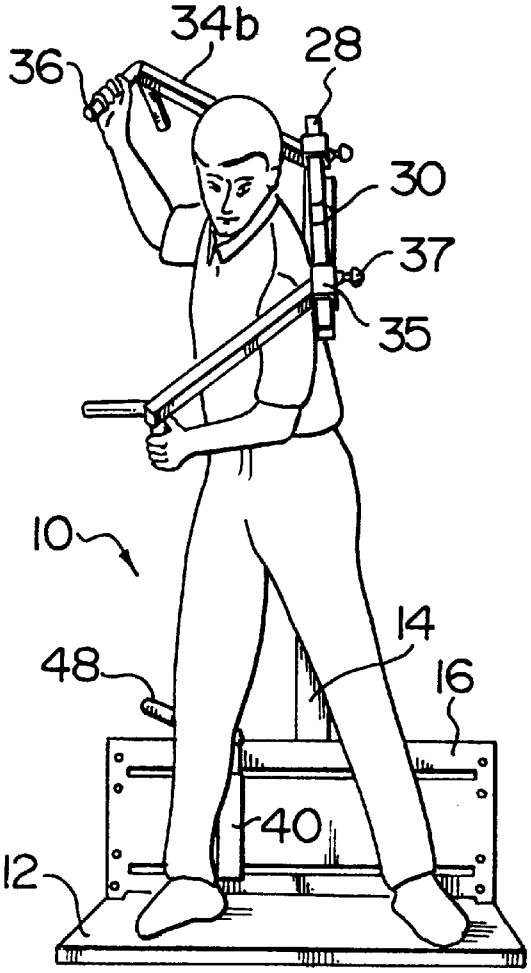

During the swing motion, shown in FIGS. 4–6, the player pivots the upper body to cause rotation of the yoke 28 while attempting to maintain contact with the yoke 28 indicating full motion of the upper body. A player practising the swing motion in the device is forced to isolate movement to pivoting the upper body reducing or eliminating errors which occur though making compensating motion. The depending arms 34 force the player's upper body into a compact position. As a player rotates against the yoke 28 in this configuration, the trailing arm 34 pushes against the arm and shoulder of the player forcing a more complete rotation and desired body posture. Because the player's centre of rotation is not at the same point as the axle 30, a lateral shift also occurs.

The distance between the centre of the player's body, about which it pivots, and the axle 30 about which the yoke 28 rotates causes a lateral shift in the upper body of the player in order to follow the yoke 28. This shift angles the player's body in a desired position to correctly swing and address a golf ball. In order to adapt to certain styles of play the lateral body shift may be eliminated by providing a second axle parallel to the primary axle 30, thus causing the yoke 28 to shift laterally while the player's body remains centred.

The leg brace 40 can be used to correct unnecessary leg movement. It is designed to be placed to the inside or outside of the leg which bends incorrectly. A common error among golfers is to bend the outer leg, and to compensate by tilting the body into the ball. The leg brace 40 is then positioned on the outside of the outer leg to prevent the knee from buckling. Further the arms 34 will not permit the player's body to tilt toward the ball. The leg brace can also be used to correct another common error of bending the inner leg away from the ball resulting in reducing the body angle achieved in rotation. Placement of the leg brace 40 to the inside of the problem leg can prevent this from occurring, and serve to make the player aware of the tendency as it occurs.

Through repetitive exercise of an exaggerated motion muscle strength and flexibility may be developed which enable a player to approximate the desired motion without the direct pressure of the apparatus 10. The apparatus 10 further provides a constant reference to which the player may return in order to repeat the same motion. This makes the device appropriate as a teaching device and also as an exercise device for regular use.

In an alternative embodiment, the standard 14 which provides a fixed reference or support for the positioning arm 18 and yoke 28 may be replaced by a door or other permanent installation. In this embodiment the yoke 28 and leg brace 40 are portable without the heavy standard 14 and base 12.

I claim:

1. A training and exercise device suitable for golf players for guiding pivotal and lateral movement of a player's upper body comprising:

a yoke for receiving a player's shoulders having at least one arm at least partially surrounding a player's body for contacting a player's shoulders, said yoke being mounted to a yoke head; means associated with said head for rotation of said yoke about a primary axis, and including means associated with said head for setting a variable angular orientation of said primary axis relative to a second horizontal axis;

a stand for supporting said yoke including means for adjustment to the height of said yoke; and a positioning arm joining said head to said stand and displacing said head forwardly of said stand.

2. An exercise device as defined in claim 1, wherein the means for rotation comprises an axle journalled for free rotation within said head.

3. An exercise device as defined in claim 2, wherein said yoke further includes means for setting a variable angular orientation of said primary axis relative to a third axis substantially perpendicular to said primary and second axes.

4. An exercise device as defined in claim 3, wherein said head comprises first and second parts and said means for setting a variable angular orientation relative to a third axis comprises a pivot pin substantially perpendicular to said axle for securing said first and second parts rotatably together.

5. An exercise device as defined in claim 4, further including a latch for variable adjustment to the position of said first and second parts of said head.

6. An exercise device as defined in claim 5, wherein said latch may be released for free rotation.

7. An exercise device as defined in claim 1, wherein said means for adjusting the orientation of said primary axis comprises a horizontal pivot pin for setting an angle of inclination about said horizontal axis pivotally supporting said yoke.

8. An exercise device as defined in claim 7, wherein said means for adjusting the orientation of said primary axis further comprises a rotative screw within a threaded bushing cooperating with a pivotally mounted support for said yoke.

9. An exercise device as defined in claim 8, wherein said pivot pin for setting an orientation to said primary axis relative to a vertical axis is also set angularly by said rotative screw and threaded bushing acting on said horizontal pivot pin.

10. An exercise device as defined in claim 1, wherein the orientation of said primary axis has an angular range relative to a horizontal axis of from substantially horizontal to substantially vertical.

11. An exercise device as defined in claim 10, wherein said primary axis has an angular range relative to a horizontal axis of from 5 degrees above horizontal to 65 degrees above horizontal.

12. An exercise device as defined in claim 1, wherein said at least one depending arm is moveable relative to said means for rotation.

13. An exercise device as defined in claim 12, wherein said yoke includes a pair of spaced apart depending arms for confining a player against said yoke.

14. An exercise device as defined in claim 13, wherein said depending arms include means for adjusting their position on said yoke.

15. An exercise device as defined in claim 14, wherein said means comprise a sleeve and thumb screw for slidable adjustment of said arms.

16. An exercise device as defined in claim 15, wherein said depending arms include hand grips.

17. An exercise device as defined in claim 16, wherein said hand grips are positioned at predetermined angles to imitate a position of a club handle during a swing.

18. An exercise device as defined in claim 1, further including at least one leg brace for abutting a player's legs.

19. An exercise device as defined in claim 18, wherein said leg brace includes substantially horizontal tracks for sliding engagement with said leg brace for lateral positioning.

20. An exercise device as defined in claim 19, further including telescopic elements for positioning said leg brace.

21. An exercise device as defined in claim 1, wherein said stand includes a vertical standard and a projecting arm movably secured to said vertical standard which supports said yoke.

22. An exercise device as defined in claim 21, wherein said stand includes a platform for a player to stand on.

23. An exercise device as defined in claim 1, wherein means for height adjustment of said yoke comprises a threaded worm gear within said vertical standard and a pinion on said projecting arm.

24. An exercise device as defined in claim 21, wherein said projecting arm includes a head portion having angular adjustment means about a horizontal axis on which said yoke is supported for setting angular orientation to said primary axis about a horizontal axis.

25. An exercise device as defined in claim 24, wherein said head portion further includes a pivot pin substantially perpendicular to said horizontal axis securing said yoke in substantially perpendicular orientation to said primary axis to said head for adjustment to said primary axis about said vertical axis.

26. An exercise device for guiding pivotal and lateral movement of a player's upper body comprising:

a support standard;

a positioning arm including means for variable height adjustment mounted to project from said standard;

a rotational axle on said positioning arm defining a primary axis of rotation having adjustment means for positioning said axle relative to two additional axes;

a yoke for receiving a player's shoulders rotatively secured by said axle to said positioning arm; and a pair of depending arms spaced apart on said yoke for confining a player against said yoke and for exerting a lateral force against a player's shoulders during rotation.

27. An exercise device as defined in claim 26, wherein said adjustment means for positioning said axle comprise a first pivot pin substantially perpendicular to said primary axis defining a substantially vertical axis, and a second pivot pin substantially perpendicular to said primary axis defining a substantially horizontal axis.

28. An exercise device as defined in claim 27, wherein a releasable latch provides variable adjustment to said axle about said first pivot pin.

29. An exercise device as defined in claim 28, wherein a rotative screw and threaded bushing provide variable adjustment to said axle about said second pivot pin.

30. An exercise device as defined in claim 26, wherein said depending arms are moveable relative to said rotation axle.

31. An exercise device as defined in claim 26 further including at least one leg brace for abutting a player's legs.

32. An exercise device as defined in claim 31, wherein the position of said leg brace is adjustable within three degrees of movement.

33. A training and exercise device suitable for golf players for guiding pivotal and later movement of a player's upper body comprising:

a yoke for receiving a player's shoulders having at least one arm for at least partially surrounding a player's body and contacting a player's shoulders, said yoke being mounted to a yoke head; a means associated with said head for rotation of said yoke relative to said head about a primary axis substantially parallel to at least a portion of a player's spine, and including means associated with said head for setting a variable angular orientation of said primary axis relative to a horizontal axis;

a stand for supporting said yoke including means for adjustment to the height of said yoke; and a positioning arm joining said head to said stand and displacing said head forwardly of said stand.

* * * * *